US008444067B2

(12) United States Patent
Schmon et al.

(10) Patent No.: US 8,444,067 B2
(45) Date of Patent: May 21, 2013

(54) FLOW RESERVOIR FOR A PAINT SPRAY GUN

(75) Inventors: Ewald Schmon, Grafenberg (DE); Peter Dettlaff, Remseck (DE)

(73) Assignee: Sata GmbH & Co. KG, Kornwestheim (DE)

( * ) Notice: Subject to any disclaimer, the term of this patent is extended or adjusted under 35 U.S.C. 154(b) by 1538 days.

(21) Appl. No.: 10/597,159

(22) PCT Filed: Jan. 18, 2005

(86) PCT No.: PCT/EP2005/000437

§ 371 (c)(1),
(2), (4) Date: Jan. 9, 2007

(87) PCT Pub. No.: WO2005/070558

PCT Pub. Date: Aug. 4, 2005

(65) Prior Publication Data

US 2009/0014557 A1 Jan. 15, 2009

(30) Foreign Application Priority Data

Jan. 22, 2004 (DE) ..... 10 2004 003 438

(51) Int. Cl.
*B05B 7/30* (2006.01)
*B05B 7/24* (2006.01)

(52) U.S. Cl.
USPC ..... 239/345; 239/302; 239/346; 239/379; 239/600; 239/DIG. 14

(58) Field of Classification Search
USPC ..... 239/346, 323, 329, 328, 375–379, 239/302, 310, 318, 340, 345, 600, DIG. 14
See application file for complete search history.

(56) References Cited

U.S. PATENT DOCUMENTS

| | | | | |
|---|---|---|---|---|
| 6,536,687 | B1 | 3/2003 | Navis et al. | |
| 6,595,441 | B2 * | 7/2003 | Petrie et al. | 239/345 |
| 6,712,292 | B1 * | 3/2004 | Gosis et al. | 239/345 |
| 6,820,824 | B1 * | 11/2004 | Joseph et al. | 239/346 |

(Continued)

FOREIGN PATENT DOCUMENTS

| | | |
|---|---|---|
| CA | 2277096 | 7/1998 |
| CA | 2445183 | 10/2002 |

(Continued)

OTHER PUBLICATIONS

International Search Report dated Mar. 5, 2005 for PCT/EP05/00437.

(Continued)

*Primary Examiner* — Darren W Gorman
(74) *Attorney, Agent, or Firm* — Martin Fleit; Paul D. Bianco; Fleit Gibbons Gutman Bongini & Bianco PL

(57) ABSTRACT

The invention relates to a flow reservoir for a paint spray gun with a bowl-shaped container (1), a cover (2) that can be set on the container (1), and an attachment part (3) for direct fixing of the flow reservoir to the paint spray gun. The flow reservoir is distinguished in that the attachment part (3) consists of a connector (5) formed directly on the cover (2) with a screw-wedge element (8) for direct quick-connect attachment of the flow reservoir to the paint spray gun.

21 Claims, 2 Drawing Sheets

U.S. PATENT DOCUMENTS

| | | | | |
|---|---|---|---|---|
| 6,877,677 | B2 * | 4/2005 | Schmon et al. | 239/346 |
| 7,036,752 | B1 * | 5/2006 | Hsiang | 239/379 |
| 7,165,732 | B2 * | 1/2007 | Kosmyna et al. | 239/346 |
| 2002/0134861 | A1 | 9/2002 | Petrie et al. | |
| 2003/0213857 | A1 | 11/2003 | Schmon et al. | |
| 2004/0140373 | A1 | 7/2004 | Joseph et al. | |
| 2010/0108783 | A1 | 5/2010 | Joseph et al. | |

FOREIGN PATENT DOCUMENTS

| | | | |
|---|---|---|---|
| DE | 34 02 097 | A1 | 8/1985 |
| DE | 89 02 223 | U1 | 4/1989 |
| DE | 10205831 | | 8/2003 |
| WO | WO 98/32539 | | 7/1998 |
| WO | WO 01/12337 | A | 2/2001 |
| WO | WO 02/085533 | A | 10/2002 |
| WO | WO 03/045575 | | 6/2003 |
| WO | WO 2004037433 | A1 * | 5/2004 |
| WO | WO 2004/037433 | A | 6/2004 |

OTHER PUBLICATIONS

Eng. Trans of International Preliminary Report on Patentability dated Oct. 3, 2006 for PCT/EP05/00437.

Eng. Trans of Written Opinion dated Oct. 2, 2006 for PCT/EP05/00437.

* cited by examiner

FLOW RESERVOIR FOR A PAINT SPRAY GUN

FILED OF THE INVENTION

The invention relates to a flow reservoir for a paint spray gun.

BACKGROUND OF THE INVENTION

Conventional flow reservoirs for paint spray guns typically have a bowl-shaped container, whose bottom side has an opening with an attachment part for detachable fastening of the container on the upper side of the paint spray gun. The attachment part typically consists of a connector that is inserted into the container floor and that has an external thread for screwing into a corresponding threaded opening on the upper side of the paint spray gun. The bowl-shaped container is usually closed on its upper side by a suitable cover, which should prevent undesired paint leakage. However, the production of such flow reservoirs with attachment parts manufactured separately and then connected to the container is relatively complicated, and is associated with correspondingly high costs.

From WO 01/12337 A1, flow reservoirs are already known that include a bowl-shaped container and a cover that can be set on this container with a hollow cylindrical attachment part. In these known flow reservoirs, however, the container cover with the cylindrical attachment part cannot be attached directly to the paint spray gun. Here, an additional adapter tailored to the attachment part is required for attaching the flow reservoir to the paint spray gun.

SUMMARY OF THE INVENTION

The task of the invention is to create a flow reservoir of the type mentioned in the introduction, which can be manufactured economically, and which can be attached quickly and easily to a paint spray gun without an additional adapter.

This task is achieved by a flow reservoir with the features of Claim 1. Preferred configurations and advantageous refinements of the invention are the objects of the subordinate claims.

One essential advantage of the flow reservoir according to the invention is that it consists of two parts that are easy to manufacture. The flow reservoir can be attached easily and quickly to the paint spray gun without an additional adapter by means of the screw-wedge element located on the cover, and can also be removed again from this gun quickly. The flow reservoir, which can be produced economically, can be filled easily and can be used either as a one-time reservoir, as a reusable container, or also as a storage container for leftover paints or lacquers.

In one preferred configuration, the screw-wedge element is formed by a groove with a screw surface extending diagonally in the circumferential direction. This screw surface is led into engagement with a corresponding counter-surface on a shoulder or projection of the paint spray gun. However, the screw-wedge element can also be configured as a wedge-shaped or screw-shaped projection, which is led into engagement with a corresponding groove on the paint spray gun.

In another advantageous configuration, the connector contains an additional thread for screwing into a conventional internal thread in an inlet opening of the paint spray gun. Thus, the flow reservoir can also be used for paint spray guns that do not have a quick-connect attachment corresponding to the screw-wedge element, but instead a conventional connection with an internal thread.

BRIEF DESCRIPTION OF THE DRAWINGS

Other details and advantages of the invention result from the following description of a preferred embodiment, with reference to the drawing. Shown are.

DETAILED DESCRIPTION OF THE INVENTION

Figure 1:
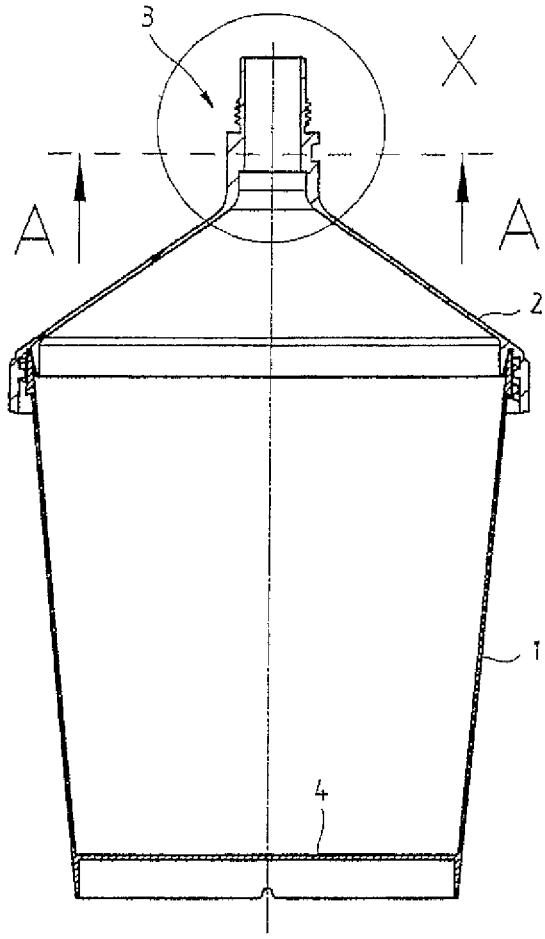
FIG. 1 a flow reservoir according to the invention in section.

The flow reservoir shown in FIG. 1 for a paint spray gun contains a bowl-shaped container 1 and a cover 2 that can be set on this container. An attachment part 3 for detachable fastening of the flow reservoir onto a paint spray gun is formed on the cover. Both the container 1 and also the cover 2 with the formed attachment part 3 are preferably produced from plastic as injection-molded parts. The bowl-shaped container 1 is filled in the position shown with the cover 2 removed. Then the cover 2 can be put in place and inserted by its attachment part 3 into the attachment opening of an upside-down paint spray gun. To spray, the paint spray gun can then be inverted, so that the flow reservoir is located on the top side of the paint spray gun. To enable ventilation of the flow reservoir, e.g., a not-shown ventilation valve, which is provided on the floor 4 of the flow reservoir, can be opened, or an initially closed ventilation channel can be punctured with the help of a pin or the like. After use, by means of a reclosable ventilation valve or a reclosable ventilation opening, there is the advantage that the flow reservoir can also be used for storing paint that has not been completely used up.

Figure 2:
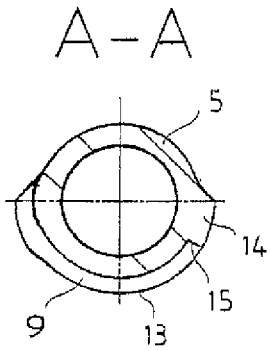
FIG. 2 a section view along the line A-A of FIG. 1.
Figure 3:
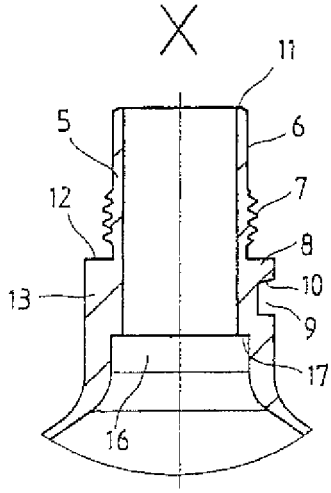
FIG. 3 a detail view of region X of FIG. 1.

The attachment part 3 shown enlarged in FIGS. 2 and 3 consists of a tubular connector 5, which is injection-molded or formed in some other way on the conical cover 2. This connector includes a front, hollow-cylindrical guidance region 6, an external thread 7 attached to this region for screwing in a conventional internal thread, and a screw-wedge element 8 connected to the external thread 7 for a quick-connect attachment of the flow reservoir to the paint spray gun. In the embodiment shown, the screw-wedge element 8 is formed by a groove 9 with a screw surface 10, which extends diagonally in the circumferential direction and which is brought into engagement with a corresponding counter-surface on a shoulder or projection of the paint spray gun. The wedge-shaped groove 9 with the screw surface 10 and the corresponding counter-surface on the paint spray gun are formed such that the flow reservoir can be fixed tightly to the paint spray gun simply by about a quarter to a half turn of the connector 5 in this way, the connector 5 is screwed down with its front end surface 11 on a corresponding sealing surface within the paint spray gun. By means of the additional external thread 7, the flow reservoir can also be used for paint spray guns that do not have an attachment that matches the screw-wedge element 8, but instead have a conventional attachment with an internal thread. Between the external thread 7 and the screw-wedge element 8, a front contact surface 12 for limiting the screw-in depth of the connector 5 is provided on the connector 5, for when the external thread 7 is used to attach the flow reservoir.

As can be seen, especially from FIG. 2, the wedge-shaped groove 9 is arranged in a shoulder 13 that extends over approximately half the circumference of the connector 5. The other half is free, so that a shoulder provided on the paint spray gun can be led into the groove 9. The groove 9 is open on its front end, while it is closed on the rear end by a ridge 14 with a contact surface 15. In this way, the quick-connect lock cannot be over-rotated.

Within the connector 5, there is a shoulder 16 shown in FIG. 3 with an annular contact surface 17. A filter, which is known and therefore not shown, can be inserted in the shoulder 16. The inner diameter of the shoulder 16 is somewhat greater than the outer diameter of the hollow-cylindrical guidance region 6. Therefore, the shoulder 16 can also be used for stacking the cover 2. If several covers 2 are stacked one on top of the other, the connector 5 of each lower cover 2 becomes engaged and guided by its hollow-cylindrical guidance region 6 into the shoulder 16 of the corresponding upper cover 2.

Figure 4:
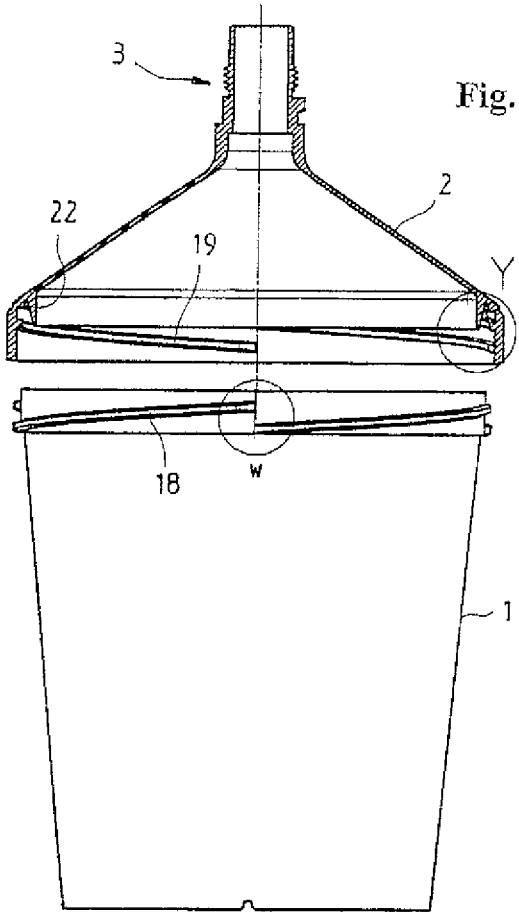
FIG. 4 a view of the bowl-shaped container and the cover of a flow reservoir with a quick-connect thread for screwing the cover onto the container.
Figure 7:
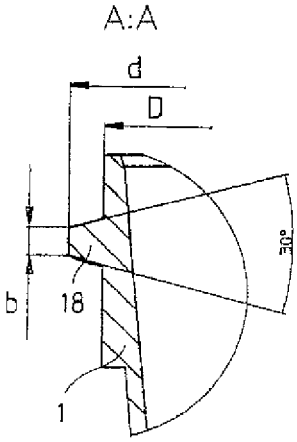
FIG. 7 a section view along the line A-A of FIG. 4.
Figure 6:
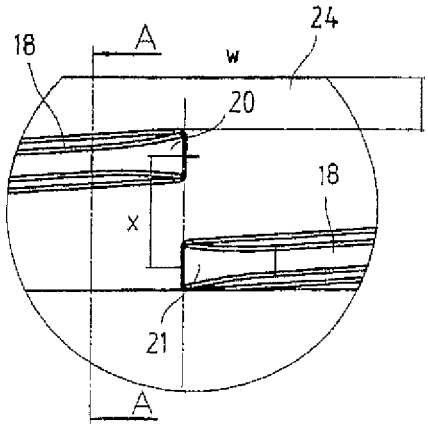
FIG. 6 a detail view of region W of FIG. 4.

For tight connection of the container 1 and the cover 2, there is a four-part quick-connect locking thread shown in FIG. 4 with external threads 18 formed on the upper external circumference of the container 1, and corresponding internal threads 19 on the cover 2. The quick-connect locking thread is configured as a steep thread with a slope of 20 mm. Therefore, the cover 2 can be screwed tightly on the container 1 by approximately a quarter turn. The four external threads 18 on the container 1 are distributed uniformly over the outer circumference and arranged according to FIG. 6 such that the beginning 20 of one thread 18 lies directly over the end 21 of the next thread 18. The distance x between the beginning 20 of one thread and the end 21 of the other thread equals 5 mm. As is evident from FIG. 7, the thread in the configuration shown is further configured as a trapezoidal thread with a flank angle of 30°. However, the quick-connect locking thread can also be configured as a round thread, triangular thread, or a thread with another suitable profile. The major diameter d of the external thread is between 100 and 110 mm, preferably 104.6 mm. The minor diameter D of the external thread is between 90 and 105 mm, preferably 101.7 mm. The width b of the thread on the outer side is between 1.1 and 1.3 mm, preferably 1.27 mm.

Figure 5:
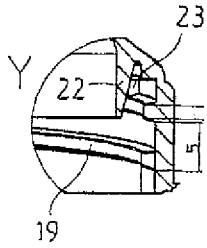
FIG. 5 a detail view of region Y of FIG. 4.

On the inner side of the cover 2, a surrounding, wedge-shaped sealing ridge 22 shown in FIG. 5 is further formed, which defines a wedge-shaped annular groove 23 between its outer side and the inner side of the cover 2 for receiving the upper container edge 24. By means of the annular groove 23, which narrows like a wedge upwards in FIG. 5, the upper container edge 24 is pressed outwards onto the inner wall of the cover 2 when the cover 2 is screwed on, which results in a tightly closed connection. The sealing ridge 22 has a sufficiently large height to catch paint still located in the cover when the cover is removed and to prevent run-off into the internal thread.

The invention is not limited to the previously described embodiment shown in the drawing. For example, an insert that can be folded up can also be put into the container for receiving the paint.

The invention claimed is:

1. A flow reservoir for a paint spray gun, the paint spray gun having either a threaded connector or a screw-wedge connector for attaching a flow reservoir, the flow reservoir comprising:

a container;

a cover attachable to said container; and an attachment part integrally formed on said cover for fastening of the flow reservoir onto the paint spray gun, the attachment part including a tubular connector portion having a threaded connector operative to releasably attach to a threaded connector of a paint spray gun, and a screw-wedge connector operative to releasably attach to a mating portion of a screw wedge connector of a paint spray gun, said screw-wedge connector of the tubular connector portion including a wedge shaped groove being open at a front end thereof and closed by a ridge having a lateral contact surface at a rear end thereof for limiting the screw-in depth of the screw wedge connector of the paint spray gun.

2. The flow reservoir according to claim 1, wherein the wedge shaped groove is arranged in a shoulder which extends over an outer circumference of the screw wedge connector of the tubular connector portion.

3. The flow reservoir according to claim 1, wherein a shoulder with a contact surface is provided in an interior of the tubular connector portion.

4. The flow reservoir according to claim 1, wherein the cover is attachable to the container with a quick-connect locking thread, wherein said quick-connect locking thread is a four part thread.

5. The flow reservoir according to claim 4, wherein the quick-connect locking thread is an external thread with a major diameter between about 100 and 110 mm, and a minor diameter between about 90 and 105 mm.

6. The flow reservoir according to claim 1, wherein a wedge-shaped sealing ridge is formed on an inner side of the cover, said wedge shaped sealing ridge defining a wedge-shaped annular groove between an outer side of said wedge shaped sealing ridge and an inner side of the cover for receiving an upper edge of the container.

7. The flow reservoir according to claim 6, wherein the wedge-shaped sealing ridge has a sufficiently large height to catch paint in the cover when the cover is removed.

8. A flow reservoir for a paint spray gun, the paint spray gun having a threaded connector or a screw wedge connector for attaching a flow reservoir, said flow reservoir comprising:

a container;

a cover attachable to said container at a first end, and attachable to the paint spray gun at a second end; and a tubular extension integrally formed on said cover extending away from said first end at said second end, the extension having a first connector and a second connector, one of said first connector and said second connector including a threaded connector matable with a threaded connector of a paint spray gun, and the other of said first connector and said second connector including a screw wedge connector matable with a screw wedge connector of a paint spray gun, the screw wedge connector of the tubular extension including a wedge shaped groove being open at a front end thereof and closed by a ridge having a lateral contact surface at a rear end thereof for limiting the screw-in depth of the screw wedge connector of the paint spray gun, the flow reservoir thereby operable to connect to either a paint spray gun having a threaded connector or a paint spray gun having a screw wedge connector.

9. The flow reservoir according to claim 8, wherein the first or second connector including a threaded connector is positioned farther from said first end relative to the first or second connector including a screw wedge connector.

10. The flow reservoir according to claim 9, wherein a wedge-shaped sealing ridge is formed on an inner side of the cover, said wedge shaped sealing ridge defining a wedge-shaped annular groove between an outer side of said wedge shaped sealing ridge and an inner side of the cover for receiving an upper edge of the container.

11. The flow reservoir according to claim 10, wherein the wedge-shaped sealing ridge has a sufficiently large height to catch paint in the cover when the cover is removed.

12. The flow reservoir according to claim 8, wherein the wedge shaped groove is arranged in a shoulder extending along an outer circumference of the screw wedge connector of the tubular extension.

13. The flow reservoir according to claim 8, wherein the cover is attachable to the container with a quick-connect locking thread, wherein said quick-connect locking thread is a four part thread.

14. The flow reservoir according to claim 13, wherein the quick-connect locking thread is an external thread with a major diameter between about 100 and about 110 mm, and a minor diameter between about 90 and about 105 mm.

15. A flow reservoir for a paint spray gun, the paint spray gun having either a threaded connector or a screw wedge connector for attaching a flow reservoir, said flow reservoir comprising:

a container;

a cover attachable to said container at a first end, and attachable to the paint spray gun at a second end; and a tubular extension integrally formed on said cover extending away from said first end at said second end, the extension having a first connector and a second connector, wherein said second connector has a greater outer diameter than an outer diameter of said first connector and said second connector is positioned between said first connector and said first end, one of said first connector and said second connector including a threaded connector matable with a threaded connector of a paint spray gun, and the other of said first connector and said second connector including a screw wedge connector matable with a screw wedge connector of a paint spray gun, the screw wedge connector of the tubular extension including a wedge shaped groove being open at a front end thereof and closed by a ridge having a lateral contact surface at a rear end thereof for limiting the screw-in depth of the screw wedge connector of the paint spray gun, the flow reservoir thereby operable to connect to either a paint spray gun having a threaded connector or a paint spray gun having a screw wedge connector.

16. The flow reservoir according to claim 15, wherein the first or second connector including a threaded connector is positioned farther from said first end relative to the first or second connector including a screw wedge connector.

17. The flow reservoir according to claim 15, wherein the wedge shaped groove is arranged in a shoulder extending along an outer circumference of the screw wedge connector of the tubular extension.

18. The flow reservoir according to claim 15, wherein a wedge-shaped sealing ridge is formed on an inner side of the cover, said wedge shaped sealing ridge defining a wedge-shaped annular groove between an outer side of said wedge shaped sealing ridge and an inner side of the cover for receiving an upper edge of the container.

19. The flow reservoir according to claim 18, wherein the wedge-shaped sealing ridge has a sufficiently large height to catch paint in the cover when the cover is removed.

20. The flow reservoir according to claim 15, wherein the cover is attachable to the container with a quick-connect locking thread, wherein said quick-connect locking thread is a four part thread.

21. The flow reservoir according to claim 20, wherein the quick-connect locking thread is an external thread with a major diameter between about 100 and about 110 mm, and a minor diameter between about 90 and about 105 mm.

* * * * *

UNITED STATES PATENT AND TRADEMARK OFFICE

CERTIFICATE OF CORRECTION

PATENT NO. : 8,444,067 B2
APPLICATION NO. : 10/597159
DATED : May 21, 2013
INVENTOR(S) : Schmon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1775 days.

Signed and Sealed this
Eighth Day of September, 2015

Michelle K. Lee

Michelle K. Lee
*Director of the United States Patent and Trademark Office*